US006467539B1

(12) United States Patent
Medessi

(10) Patent No.: US 6,467,539 B1
(45) Date of Patent: Oct. 22, 2002

(54) UNIVERSAL EQUIPMENT FOR THE COOLING FLUID REGENERATION IN HEAT EXCHANGE CIRCUITS

(75) Inventor: Enrico Medessi, Gorizia (IT)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/445,965

(22) PCT Filed: Jun. 26, 1998

(86) PCT No.: PCT/IT98/00178

§ 371 (c)(1),
(2), (4) Date: Feb. 11, 2000

(87) PCT Pub. No.: WO99/01711

PCT Pub. Date: Jan. 14, 1999

(30) Foreign Application Priority Data

Jul. 2, 1997 (IT) ..... UD97A0118

(51) Int. Cl.[7] ..... F28D 5/00; F28D 3/00

(52) U.S. Cl. ..... 165/300; 165/288; 165/296; 165/60; 165/62; 165/900; 62/95; 62/171; 62/304

(58) Field of Search ..... 165/47, 60, 62, 165/201, 296, 63, 900, 244, 288, 289, 299, 300; 62/304, 305, 95, 171, 271

(56) References Cited

U.S. PATENT DOCUMENTS

| | | | | | |
|---|---|---|---|---|---|
| 2,353,233 | A | | 7/1944 | Gygax | |
| 3,265,122 | A | * | 8/1966 | Ostrander | 165/60 |
| 3,625,279 | A | * | 12/1971 | Mayo | 165/62 |
| 3,864,929 | A | * | 2/1975 | Hopkins | |
| 3,895,499 | A | * | 7/1975 | Hopkins | |
| 4,070,870 | A | * | 1/1978 | Bahel et al. | |
| 4,098,854 | A | * | 7/1978 | Knirsch et al. | 165/900 X |
| 4,439,997 | A | * | 4/1984 | Cantley | |
| 4,457,358 | A | * | 7/1984 | Kriege et al. | 165/63 X |
| 4,475,356 | A | | 10/1984 | Lewis | |
| 4,730,462 | A | * | 3/1988 | Rogers | 62/305 X |
| 4,910,971 | A | * | 3/1990 | McNab | |
| 5,553,463 | A | * | 9/1996 | Pointer | 62/305 X |
| 5,787,722 | A | * | 8/1998 | Jenkins | 62/305 |
| 6,041,613 | A | * | 3/2000 | Morse et al. | 62/305 |

FOREIGN PATENT DOCUMENTS

| | | | | |
|---|---|---|---|---|
| DE | 43 25 945 A1 | * | 2/1995 | |
| DE | 296 06 863 | | 7/1996 | |
| EP | 0 006 412 A1 | | 1/1980 | |
| EP | 0 993 587 B1 | | 6/1998 | |
| FR | 2 275 742 | | 1/1976 | |
| FR | 2 544 470 | | 10/1984 | |
| JP | 59-95324 | * | 6/1984 | 165/60 |
| JP | 9-152227 | * | 6/1997 | |
| SU | 1330410 A1 | * | 8/1987 | 165/60 |

* cited by examiner

*Primary Examiner*—Ljiljana Ciric

(57) ABSTRACT

Cooling equipment, which may be connected to the water discharge from a working or operating machine with a water (20/20') cooling circuit (2) to make the water re-circulate once cooled (24), characterized in that the cooling equipment comprises: at least one cooling tower (21–21') with an extended surface for wetting and evaporation; at least one air flow generator device (3–31) for easing the evaporation; at least one closed cycle frigorific circuit (1) whose condenser (12) is placed downstream (12') of the cooling tower (21–21') with respect to the air flow (3–31) and whose evaporator (14) is placed downstream of the water cooling circuit (2) for exchanging heat with the cooled water (22) in the cooling tower (2–21') for then making the water re-circulate in the operating machine (24).

13 Claims, 4 Drawing Sheets

UNIVERSAL EQUIPMENT FOR THE COOLING FLUID REGENERATION IN HEAT EXCHANGE CIRCUITS

TECHNICAL FIELD

The present invention provides the universal equipment for cooling fluid regeneration via heat exchange circuits.

The invention applies water cooling heat exchange circuits to industrial machines such as ice cream production machines or plastic material moulding machines (moulds cooling), etc.

BACKGROUND ART

It is known in the art that there are many types of machines using water cooling circuits which generally discharge the waste water without recirculation. Recirculation involves high costs and consumption of water which nowadays is so precious.

The cooling water generally exits at a temperature about 35–40° C.

To avoid the high costs deriving from waste of the cooling water, equipment recirculating the water by cooling it were studied.

This equipment is substantially made like a cooling tower which involves the recirculation of the water from the to-be-cooled machine, and is subject to a heat exchange by passing through a forced air-jet and by using an evaporating system, which eventually and preferably are combined with the heat exchange along with frigorific circuit condensing panels.

In the cooling tower and in the water-air exchanger (evaporating type), the temperature at which the water may be regenerated cannot go below the temperature of the humid bulb of the air used.

A water-air exchanger of the non-evaporating type (for example, dry-finned exchangers), the temperature at which the water may be regenerated cannot go below the temperature of the dry bulb of the air used and thus the range for temperature decrease is even more limited.

Also auxiliary cooling machines which use condensers operating in closed cycle frigorific circuits have the drawback of being unsuitable for different periods of the year or different specific needs.

It should also be considered that if the cooling apparatus does not always cool the machine with water in proportion, a vicious circle may actually endanger the machine and may even cause other damage.

Obviously these problems may be reduced if the machine is cooled by using the disposable system water, because in this case the system water during the day has substantially the same temperature. Therefore, it would only be necessary to vary the water delivery for running the machine to be cooled perfectly, but this solution would be extremely expensive and ineffective in summertime. Therefore, it is certainly more convenient using the equipment of this invention to substantially realize a closed cooling circuit.

In the case of a closed cooling circuit, if the cooling apparatus does not eliminate all the temperature increases, which the working machine yields, the closed circuit water temperature, tends to continuously increase in a vicious cycle which is difficult to eliminate without damaging the operating machine.

If, for example, the increase of the water temperature, which circulates in the operating machine, is 15° C., it is obvious that the cooling apparatus should subtract exactly 15° C. If it subtracts only 14° C., at each water recirculation, the water will increase its temperature just a little less than one degree and even if progressively less, thereby reaches a point that endangers the work and damages the machine (operating) due to inadequate cooling of the operating machine circuit.

Vice versa, if the cooling apparatus subtracts too much temperature, the working machine would work in non-optimal temperature conditions.

DE 296 06 863 U1 (BKZ ANLAGENBAU GMBH) discloses a device for cooling liquids with a freezing coolant closed circuit.

FR 2 544 470 A (HIROSS INTERNATIONAL CORP. S.A.) discloses a cooling unit for cooling fluids in an air conditioned installation with vent supply.

OJBECT OF THE PRESENT INVENTION

The object of the present invention is to obviate the above-mentioned drawbacks by creating equipment for supplying cooling water which is proportional to the working machine's needs, independently of the same machine working charge and of the environmental temperature, and also to be able to adapt to any cooling condition, both by cooling tower means and frigorific means, jointly or independently.

DISCLOSURE OF THE INVENTION ESSENCE

These and other objects are achieved as claimed by cooling equipment, which may be connected to the water discharge from a to-be-cooled machine and makes the water recirculate once cooled. The cooling equipment includes:

- at least one cooling tower with an extended surface to be wetted by the water so that a portion of the water was evaporated;
- at least one air draft generator device for forcing air through said cooling tower so as to cool the water and thereby minimize the water form evaporation;
- at least one closed cycle frigorific circuit:
- whose condensing means, such as condensers, are placed downstream of said cooling tower placing with respect to said air flow; and
- whose evaporator is placed downstream of said water circuit for exchanging heat with the water cooled in said cooling tower for subsequent recirculation in said operating machine.
- said condensing means being two, one placed upstream and opne downstream of said cooling tower and at least on of the condensing means being activated.

Thus, the invention makes the cooling system more effective and with a higher yield, and reduces the temperature of the water to be cooled to a rather low value (reduced heat exchange thermal head).

In the preferred solution, said condensing means are placed both upstream and downstream of said tower, which makes possible a maximum cooling by operating in both conditions.

It is more advantageous when the following additional means are provided:

- water temperature sensing means (Te), such as a sensor at the entry port of the hot water, and controlled valve means for discharging the hot water on the entry port in certain conditions;
- between said hot water entry port and the cold water exit port, means for letting in cold water from a supplying system;

on the cooled water exit port, cooled water temperature sensing means;

means for comparing one and/or the other temperature and at least one exit port for operating said valve means (for the hot water discharge and cold water inlet on entry).

Another advantage is to perfectly calibrate the cooling plant with less water loss.

It is advantageous that the panel in contact with the cooling tower is extractable which makes possible a further cooling under certain conditions by operating only the frigorific circuit.

DESCRIPTION OF CERTAIN PREFERRED FORMS OF EMBODIMENT

These and other advantages will be apparent from the following description of a preferred solution, with the aid of the attached drawings whose execution details are not to be considered as the limits but are only given as examples.

Figure 1:
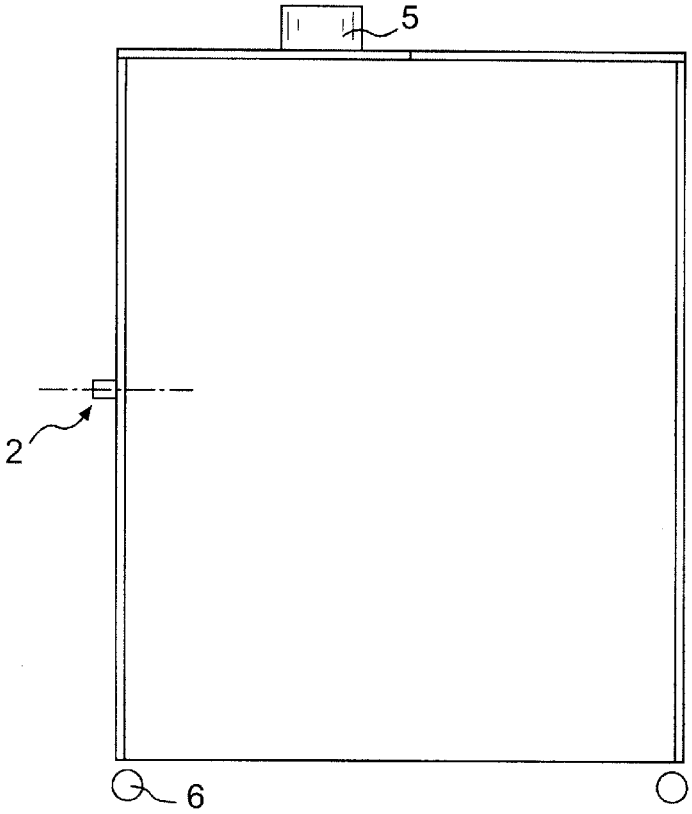
FIG. 1 is a side elevation schematic view of the equipment with covering panel which shows on the side that there are neither connections nor controls for making possible an adhesion to a wall or to another piece of equipment.
Figure 2:
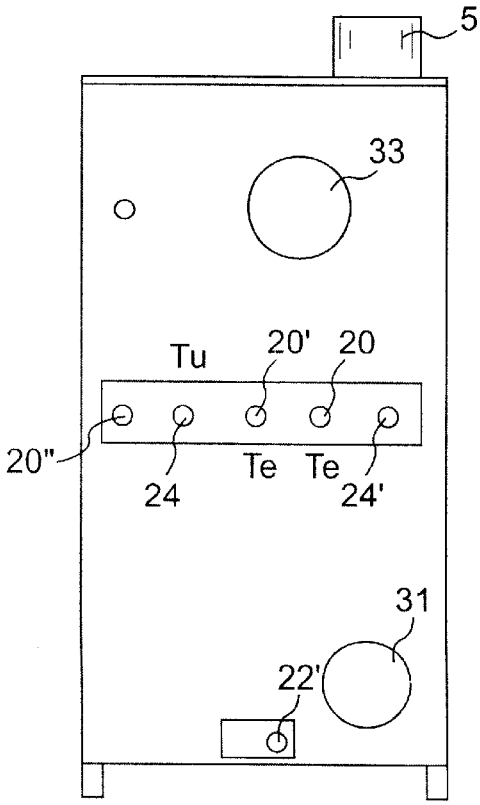
FIG. 2 is a rear elevation view of the equipment seen from the side where the connection pipes connect the water to the system, and of the circuit water which must be cooled in an operating machine.
Figure 3:
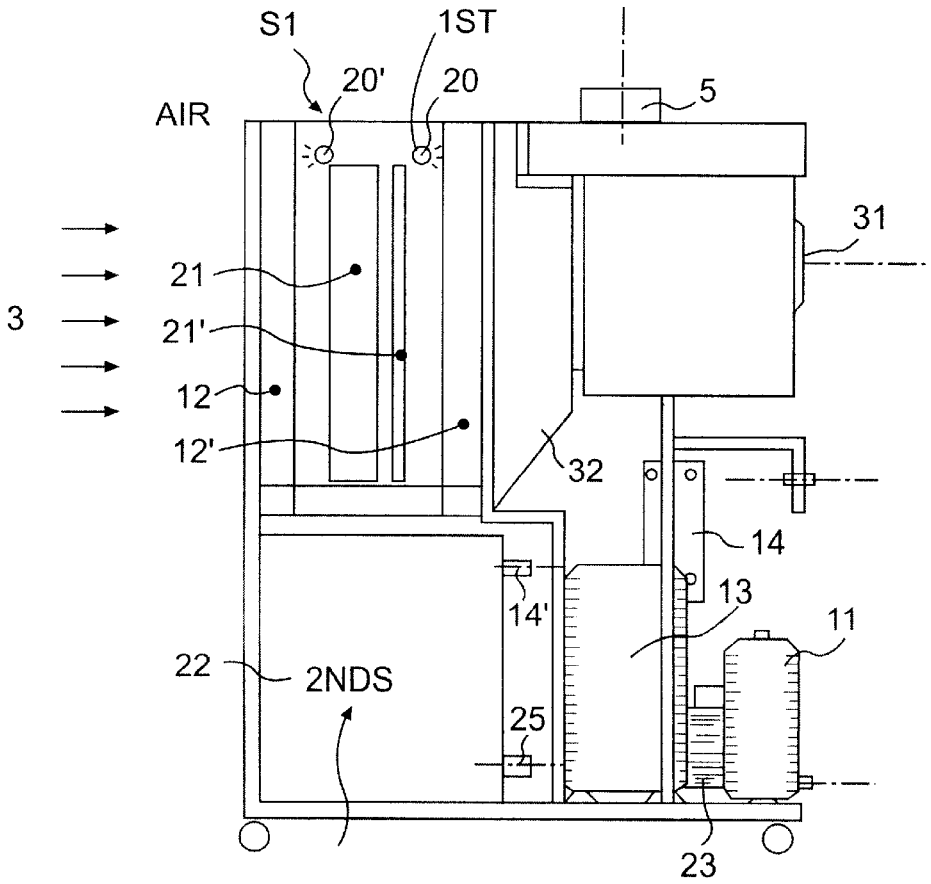
FIG. 3 is a side elevation view of the machine without the lateral covering panel showing the internal apparatus and devices.
Figure 4:
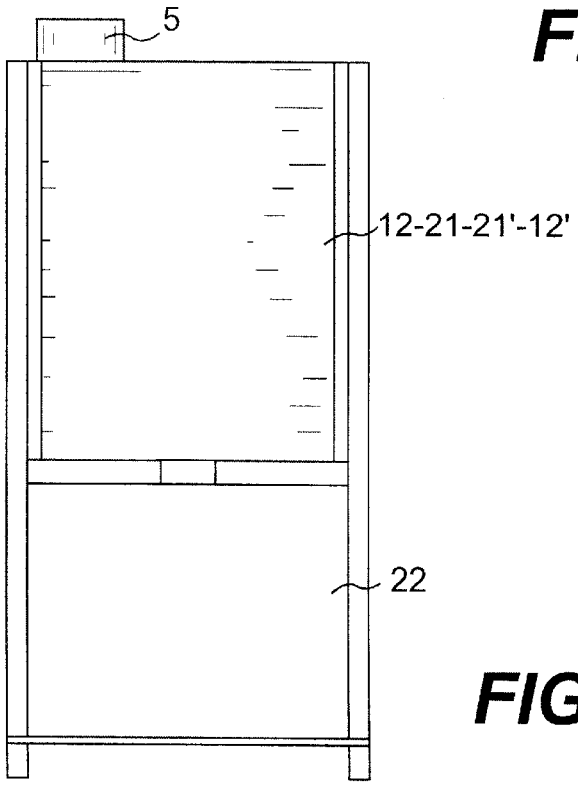
FIG. 4 is a front view of the equipment in which a large mouth contacting the panelling for the heat exchange with the environmental air which is sucked towards the machine interior.
Figure 5:
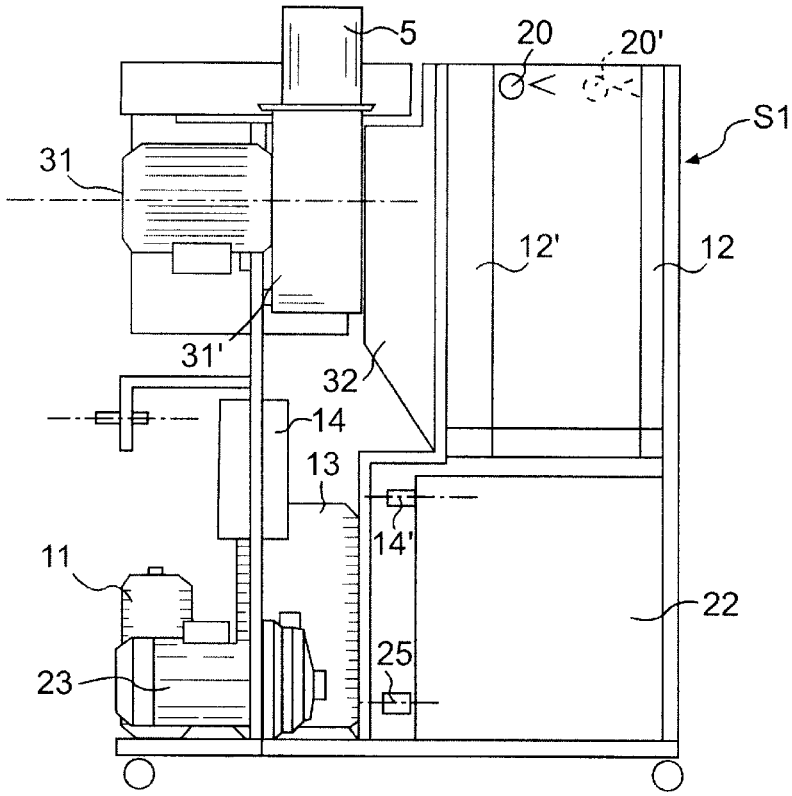
FIG. 5 shows the equipment interior on the other side where the package contacting the cooling tower has been extracted for alternative functions or for replacements.
Figure 6:
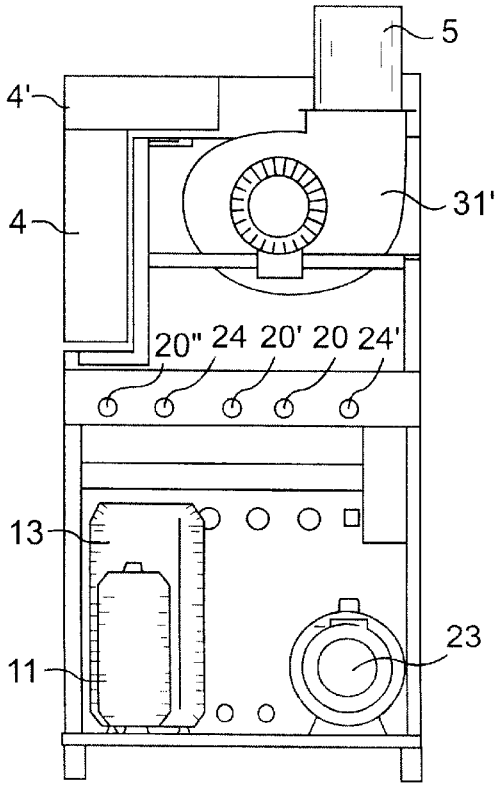
FIG. 6 shows the equipment interior from the back side with the respective covering panel removed as in FIG. 2.
Figure 7:
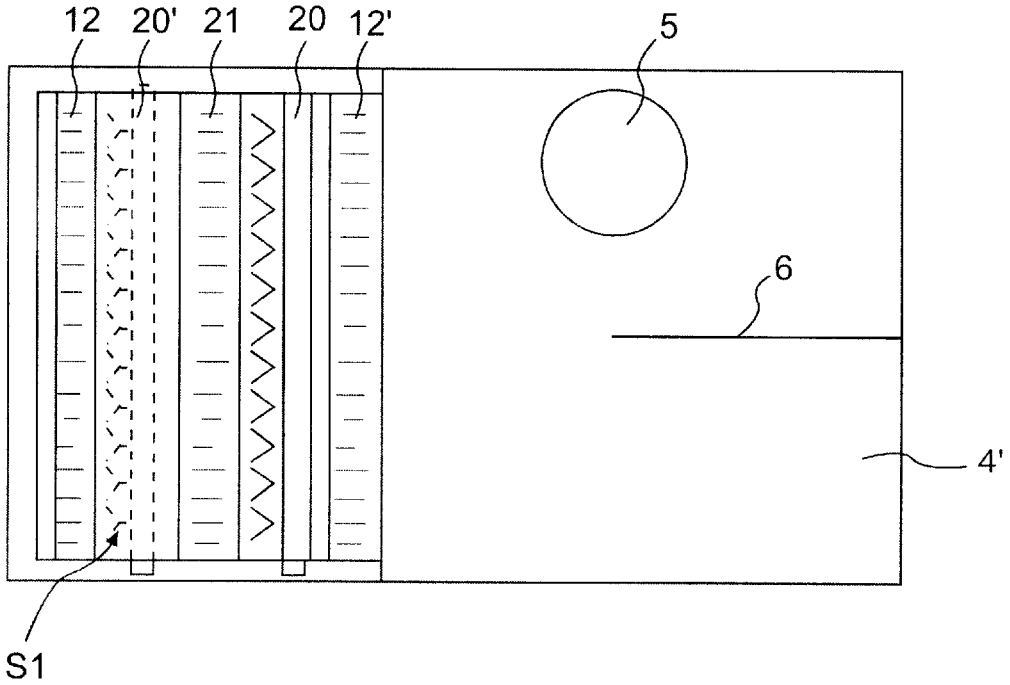
FIG. 7 shows a top view of the equipment displaying the panels for the heat exchange with the external air flow of which the central contacting the cooling tower or cooling package is extractable and interchangeable.
Figure 8:
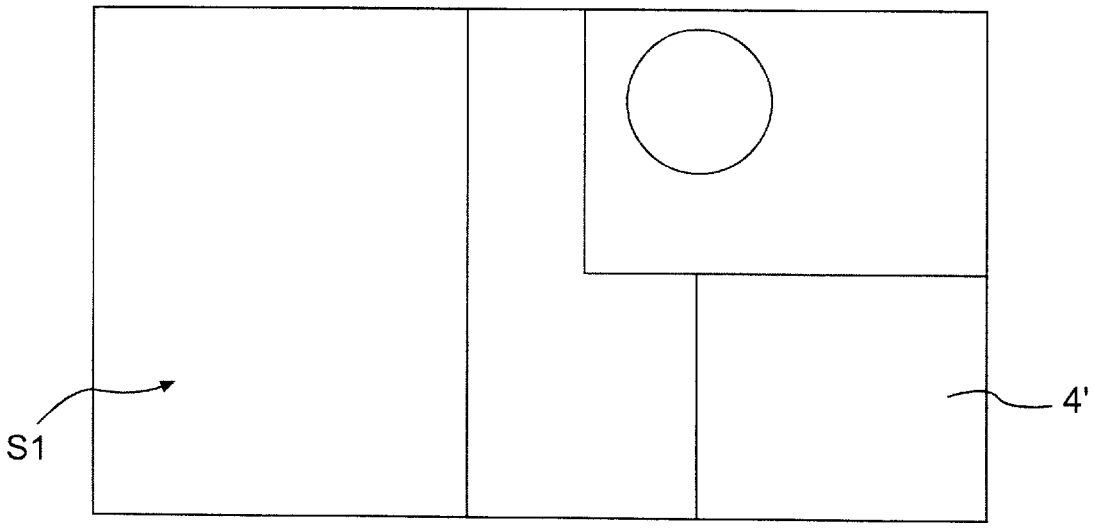
FIG. 8 shows the top view of the machine with the control panel positioned on the respective side of the upper corner.

Referring to the figures, it may be noticed that:

The frigorific circuit 1 comprises the devices enumerated from 11 to 14, where 11 is the compressor 12 and 12' are the condensers placed upstream and downstream of the cooling tower indicated with 20–21; 13 is a frigorific liquid receiver and 14 is an evaporator.

The water cooling circuit 2 comprises the entry port (20) with sprayers (20, 20') (one at the cooling tower (20) and the second one (20') at the first upstream condenser (12)), means for collecting the water beneath said cooling panels, made up of a collection tank 22, from which by means of a water recirculation pump 23 and exit duct (14') the water is conveyed to the heat exchange with the evaporator (14) for subsequent recirculation by the discharge connection (24) in the to-be-cooled machine.

The water collection tank 22 has a discharge piping (25).

The water circuit 3 comprises the motor-fan 31–31' suction and the air is discharged upward 5.

The air 3 passes through the first condenser 12, the cooling panel for evaporation 21 and the respective drops separator 21' and finally through the second condenser (12).

The water yield back connections are:

a system with cold water entry port for reintegrating and eventually additional cooling in case of need (20");

a warm water entry port (20') for guiding water to be refrigerated from the operating machine, without passage to the cooling tower but only to the heat exchange with the evaporator (14);

an alternative hot-water entry port of the operating machine (20) in maximum temperature conditions and for which a maximum heat exchange is required with maximum temperature lowering;

hot water discharge in case of need or of particular intervention, as also explained hereinafter.

The control board is indicated with 4' and the respective box containing the electric, programming and control equipment is indicated with 4.

AUXILIARY INTERVENTION SOLUTIONS

In the preferred embodiment at the entry ports (20/20'), a valve (advantageously an electro valve) for the hot water discharge (24') and a valve (advantageously an electro valve) for the system cold water entry port (20") are provided.

For example, when the exit temperature Tu is too high (e.g., >25° C.), the program activates discharging of a certain amount of hot water from the respective valve and supplies corresponding cold water from the other respective valve.

Thus the cooling circuit is balanced again.

Of course, it is also possible to operate on parameters which concern the entry temperature (Te), etc.

The air entry from the outside has the air temperature as the environmental one Ta.

The air is heated at Tm(>Ta) while passing through the condensing means (12) and becomes dry.

In the meantime, on entry ports (20, 20') the working fluid (liquid) has a temperature Te(>Tm); therefore, in the tower (21) this working fluid is cooled at a certain value, while the air comes out from the opposite side (5) at a temperature TF(>Tm).

The heat exchanges yield (12, 21) may be improved by using an external evaporative system, e.g., in drops or water spraying (20, 20').

Before being discharged (24), the working fluid is made pass through the evaporator 14 of the frigorific circuit to be cooled further to a temperature Tu(<Te).

The exit temperature Tu thus reaches extremely low values with respect to the environmental temperature or even about 0° C.

Advantageously, said evaporator (14) in a more effective embodiment is immersed in said water collection tank (22).

Also advantageously said air forced circulation means comprise means for reversing the air flow so as to obtain the upstream arrangement of a downstream means or vice versa.

Thus, the great advantage of maximum flexibility is achieved by using only one condensing means.

As can be seen from the figures, the cooling equipment advantageously has a parallelepiped-like box shape having the control panel (4–4') at the top and with a first air flow heat exchange compartment (3-S1) for inserting both the cooling tower panels (21–21') and the frigorific circuit heat exchange panels (12, 12'), the water delivery means (20, 20') being arranged at the top and a collection tank for the same water (22) being arranged at the bottom for recirculation

(24) in a cooling cycle of an operating or working machine. With this structure, the advantage of using one and/or the other of the systems, according to the specific needs, is obtained.

What is claimed is:

1. Cooling equipment adapted for cooling and recirculating water discharged from a to-be-cooled machine, said cooling equipment comprising:

at least one cooling tower with an extended surface to be wetted by the water so that a portion of the water evaporates;

at least one air flow generator device for forcing air extracted from outside of the cooling equipment to flow through said at least one cooling tower so as to cool the water and thereby minimize evaporation of the water;

at least one water controller for discharging another portion of the water from the cooling equipment and for introducing new water into the cooling equipment when the temperature of the water at a water entry port or at a water exit port of the cooling equipment reaches a predetermined value; and, at least one closed cycle frigorific circuit including:

at least one condenser, and an evaporator disposed downstream of said at least one cooling tower with respect to the flow of the water for exchanging heat with the cooled water in said at least one cooling tower, and for thereby recirculating the cooled water back to the to-be-cooled machine, wherein said at least one condenser is disposed upstream or downstream of said at least one cooling tower with respect to the air flow, and wherein at least one of said at least one condenser is activated.

2. The cooling equipment according to claim 1, wherein said at least one condenser communicates with a water spraying means for spraying water from the to-be-cooled machine so as to cool the water by evaporation.

3. The cooling equipment according to claim 1, wherein said at least one cooling tower communicates with a water spraying means for spraying water from the to-be-cooled machine so as to cool the water by evaporation.

4. The cooling equipment according to claim 1, wherein said at least one cooling tower has a top and at least one cooling panel which is open or openable at said top for extracting said at least one cooling panel so as to replace said at least one cooling panel or so as to cool said at least one cooling tower.

5. The cooling equipment according to claim 1, wherein a water collection tank is installed beneath said at least one cooling tower and beneath said at least one condenser.

6. The cooling equipment according to claim 5, wherein the water cooled in said water collection tank is conveyed to exchange heat with said evaporator.

7. The cooling equipment according to claim 6, wherein said evaporator is immersed in said water collection tank for heat exchange.

8. The cooling equipment according to claim 1, wherein a water temperature sensor and a controlling valve means for discharging hot water are provided at the water entry port or at the water exit port a means for introducing new water from a supply system is provided between the water entry port and the water exit port;

a cooled water temperature sensor is provided at the water exit port; and a means for comparing the temperature at at least one of the water exit port and the water entry port is provided so as to control discharge of the water via a discharge valve.

9. The cooling equipment according to claim 8, wherein a cold water inlet is disposed between said temperature sensor disposed at the water entry port and said cooled water temperature sensor disposed at the water exit port.

10. The cooling equipment according to claim 1, wherein the water entry port is positioned between said at least one cooling tower and said evaporator.

11. The cooling equipment according to claim 8, wherein said discharge valve is an electro-valve.

12. The cooling equipment according to claim 1, further comprising air ventilation means for inverting the air flow extracted from outside of the cooling equipment to flow through said at least one cooling tower.

13. The cooling equipment according to claim 1, further comprising:

a parallelepiped-shaped box with a control panel at the top of the cooling equipment;

an air flow heat exchange compartment for accommodating cooling tower panels and heat exchange panels;

a water delivery means for delivering water, said water delivery means disposed at the top of the cooling equipment; and a collection tank disposed at the bottom of the cooling equipment.

* * * * *

UNITED STATES PATENT AND TRADEMARK OFFICE

CERTIFICATE OF CORRECTION

PATENT NO. : 6,467,539 B1
DATED : October 22, 2002
INVENTOR(S) : Medessi

It is certified that error appears in the above-identified patent and that said Letters Patent is hereby corrected as shown below:

Title page,
Item [73], Assignee, please delete "Hitachi, Ltd., Tokyo (JP)" and leave it blank.

Signed and Sealed this

Twenty-fifth Day of March, 2003

JAMES E. ROGAN
*Director of the United States Patent and Trademark Office*